US007311374B2

(12) United States Patent
Oomura

(10) Patent No.: US 7,311,374 B2
(45) Date of Patent: Dec. 25, 2007

(54) LIQUID DISCHARGE CARTRIDGE AND LIQUID DISCHARGE APPARATUS

(75) Inventor: Masanobu Oomura, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 376 days.

(21) Appl. No.: 11/101,541

(22) Filed: Apr. 8, 2005

(65) Prior Publication Data

US 2005/0225614 A1 Oct. 13, 2005

(30) Foreign Application Priority Data

Apr. 9, 2004 (JP) ..... 2004-115339

(51) Int. Cl.
*B41J 29/393* (2006.01)
*B41J 2/175* (2006.01)

(52) U.S. Cl. ..... 347/19; 347/87

(58) Field of Classification Search ..... 347/5, 347/7, 19, 56, 85, 87; 711/103; 73/304 C
See application file for complete search history.

(56) References Cited

U.S. PATENT DOCUMENTS 5,988,783 A * 11/1999 Tajika et al. ..... 347/7
6,089,688 A * 7/2000 Froger et al. ..... 347/7
6,106,087 A * 8/2000 Kishi ..... 347/7
6,155,664 A * 12/2000 Cook ..... 347/7
6,719,394 B2 4/2004 Kubota et al. ..... 347/19
6,984,012 B2 * 1/2006 Asauchi ..... 347/19
7,188,520 B2 * 3/2007 Usui et al. ..... 73/290 V
2005/0099458 A1 * 5/2005 Edelen et al. ..... 347/54

FOREIGN PATENT DOCUMENTS

JP 9-314861 12/1997
JP 10-100447 4/1998

* cited by examiner

*Primary Examiner*—Anh T. N. Vo
(74) *Attorney, Agent, or Firm*—Fitzpatrick, Cella, Harper & Scinto

(57) ABSTRACT

A head cartridge has a print head which discharges ink, and an ink tank which contains ink which is supplied to the print head. A sensor which detects residual ink amount in the ink tank is provided in the ink tank. The print head includes a detection circuit which detects the presence of residual ink amount using the sensor, a judgment circuit which judges the presence of residual ink amount on the basis of an output from the detection circuit and outputs ink zero information when judging that there is no residual ink amount, and nonvolatile memory which stores ink zero information when the ink zero information is outputted from the judgment circuit.

1 Claim, 7 Drawing Sheets

LIQUID DISCHARGE CARTRIDGE AND LIQUID DISCHARGE APPARATUS

BACKGROUND OF THE INVENTION

1. Field of the Invention

The present invention relates to a liquid discharge cartridge with the structure of having a liquid discharge element and a switching circuit, including a liquid discharge head applicable to an apparatus used for the production of a DNA chip, an organic transistor, a color filter, or the like, and a liquid container which contains liquid supplied to this. The liquid discharge head discharges liquid by injecting energy into a liquid discharge element and makes liquid droplets adhere on a medium, and in particular, relates to an ink jet recording head using ink as the liquid.

2. Related Background Art

A liquid discharge apparatus will be explained with an example of an ink jet recording apparatus. One of structures of detecting residual ink amount in an ink tank in a conventional ink jet recording apparatus (ink jet printer) will be explained. First, the change of the electrostatic capacitance which varies according to ink residual amount is converted into an output signal (pulse signal) in an oscillation circuit provided in a CR circuit, and is outputted. The output signal is inputted into a central processing unit (hereinafter, a "CPU") of a host computer which controls the printer. Then, the structure of detecting the change of a frequency of the pulse signal and detecting the residual ink amount in the CPU is known.

In this conventional structure, since the output signal outputted from the oscillation circuit is directly inputted into the CPU of the host computer, there is a problem that the processing burden of the CPU of the host computer becomes heavy. Then, in order to solve this problem, the structure relating to Japanese Patent Application Laid-Open No. H10-100447 has been proposed.

FIG. 10 is a circuit diagram of residual ink amount detection equipment shown in the above-mentioned gazette. A signal A is outputted from an electrostatic detection circuit 1051 where an oscillation frequency varies according to the residual ink amount in an ink tank 1057. Then, a signal B is outputted from a reference signal generating circuit 1039. The logical operation of them is performed in a NAND circuit 1040, and the CPU compares an output signal C of the NAND circuit 1040 to the signal B. Thereby, the load of the CPU is reduced in comparison to the structure that the output signal outputted from the oscillation circuit is directly inputted into the CPU of the host computer. Then, it becomes possible to enhance processing speed as a whole.

In addition, some printers are constituted so as to count the number of times of discharge of ink by each CPU and may estimate residual ink amount. An ink jet unit being equipped with an memory element in which the number of drive pulses expressing the number of times of ink discharge and the number of times of suction recovery treatment are written is disclosed in Japanese Patent Application Laid-Open No. H09-314861. FIG. 11 is a drawing showing in multiple the structure of a conventional ink jet unit shown in the above-mentioned gazette.

The ink jet unit shown in FIG. 11 is formed by integrating a head 2010 and an ink tank 2014. This unit is mounted detachably in a carriage (not shown) of a recording apparatus. In the drawing, a memory element 2011 is constituted of, for example, EEPROM (Electrically Erasable Programmable Read-only Memory) which is nonvolatile memory. The memory element 2011 is mounted on a PCB substrate 2012, and a plurality of heat-generating resistors (not shown) are provided on a silicon substrate 2013 corresponding to the number of ink ejection orifices. The silicon substrate 2013 and PCB substrate 2012 are electrically connected by wire bonding. A terminal 2015 is provided in an end portion of the PCB substrate 2012, and electrically connects a head 2010 to an apparatus body. When being mounted in the carriage, the ink jet unit is connected to a connector provided on the carriage. The head 2010 is equipped with the above-mentioned respective elements. On the other hand, an ink tank 2014 stores ink supplied to the head 2010.

According to this structure, the number of drive pulses expressing the number of times of ink discharge, and the number of times of suction recovery treatment are written in the memory element 2011 in the head 2010. Thus, accumulated values such as the number of drive pulses relating to ink amount consumed by the head 2010 are stored. In order to know residual ink amount, data is first fetched from the memory element 2011 by read and write means provided in the recording apparatus. Then, a CPU of the recording apparatus or the like subtracts ink consumption corresponding to the number of drive pulses and the number of times of suction recovery treatment, which are recorded in the data, from the initial ink amount of the ink tank 2014. Owing to this, it becomes possible to know the residual ink amount in the ink tank 2014. In addition, when the memory element 2011 is nonvolatile memory such as EEPROM, the information stored in the memory element 2011 is not erased even if the ink jet unit is removed from the recording apparatus.

In addition, U.S. Pat. No. 6,719,394 discloses the structure of arranging a ball-shaped semiconductor device in the interior or exterior of a container such as an ink tank, and detecting information inside the ink tank. This device is equipped with energy conversion means, information acquisition means of acquiring environmental information around the device, and judgment means. Furthermore, the device is equipped with information storage means of accumulating information for being compared with the information, acquired by the information acquisition means, by the judgment means, and information transmission means 18 of transmitting the acquired information to the outside by the judgment of the judgment means 16.

Nevertheless, the conventional residual ink amount detection equipment shown in FIG. 10 cannot detect the residual ink amount without using the CPU of the host computer. Therefore, a processing burden arises in the CPU of the host computer, and in order to detect the residual ink amount, a user has to start both the host computer and recording apparatus, and hence, this is inconvenient for a user. Nevertheless, when the processing capability currently performed by the CPU is separately installed in the recording apparatus in order to detect the residual ink amount, the cost of the recording apparatus increases.

In addition, in the structure of counting the number of times of discharge of ink and estimating the residual ink amount by a CPU of a recording apparatus as shown in FIG. 11, a processing burden also arises in the CPU of the recording apparatus.

In addition, in the structure in U.S. Pat. No. 6,719,394, it is necessary separately to provide a three-dimensional semiconductor device. Furthermore, since a drive power supply also has the structure of converting external force and the like into energy by energy conversion means, structure is complicated, and hence, the further simplification of a detection system is required.

Then, the present invention aims at providing a liquid discharge cartridge with the structure that information about the presence of residual liquid amount stored in the memory of the liquid discharge cartridge is not erased even if the liquid discharge cartridge is removed from a liquid discharge apparatus, and that a processing burden is not made to arise in a CPU of a host computer or the liquid discharge apparatus.

SUMMARY OF THE INVENTION

In order to achieve the above-described objects, in a liquid discharge cartridge having a liquid discharge head discharging liquid, and a liquid container containing the liquid supplied to the liquid discharge head, a liquid discharge cartridge of the present invention is characterized in that a sensor for detecting the residual liquid amount in the liquid container is provided in the liquid container, and that the liquid discharge head includes detection means of detecting the residual liquid amount in the liquid container using the sensor, judgment means of judging the presence of the residual liquid amount in the liquid container on the basis of an output from the detection means, and outputting zero residual liquid amount information when judging that there is no residual liquid amount in the liquid container, and nonvolatile memory means of storing the zero residual liquid amount information when the zero residual liquid amount information is outputted from the judgment means.

In the liquid discharge cartridge of the present invention, the detection means detects residual liquid amount in the liquid container by the sensor provided in the liquid container, and outputs a signal, having correlation in the residual liquid amount, to the judgment means. The judgment means judges the presence of the residual liquid amount in the liquid container on the basis of an output from the detection means, and outputs information having correlation to zero residual liquid amount (zero residual liquid amount information) to the nonvolatile memory means. The nonvolatile memory means stores this when the zero residual liquid amount information is inputted from the judgment means. In this way, when it is detected that the residual liquid amount in the liquid container is zero, zero residual liquid amount information is stored in the nonvolatile memory means.

Other features and advantages of the present invention will be apparent from the following description taken in conjunction with the accompanying drawings, in which like reference characters designate the same or similar parts throughout the figures thereof.

The accompanying drawings, which are incorporated in and constitute a part of the specification, illustrate embodiments of the invention and together with the description, serve to explain the principles of the invention.

DETAILED DESCRIPTION OF THE PREFERRED EMBODIMENTS

Next, embodiments of the present invention will be described with referring to drawings.

First Embodiment

Figure 1:
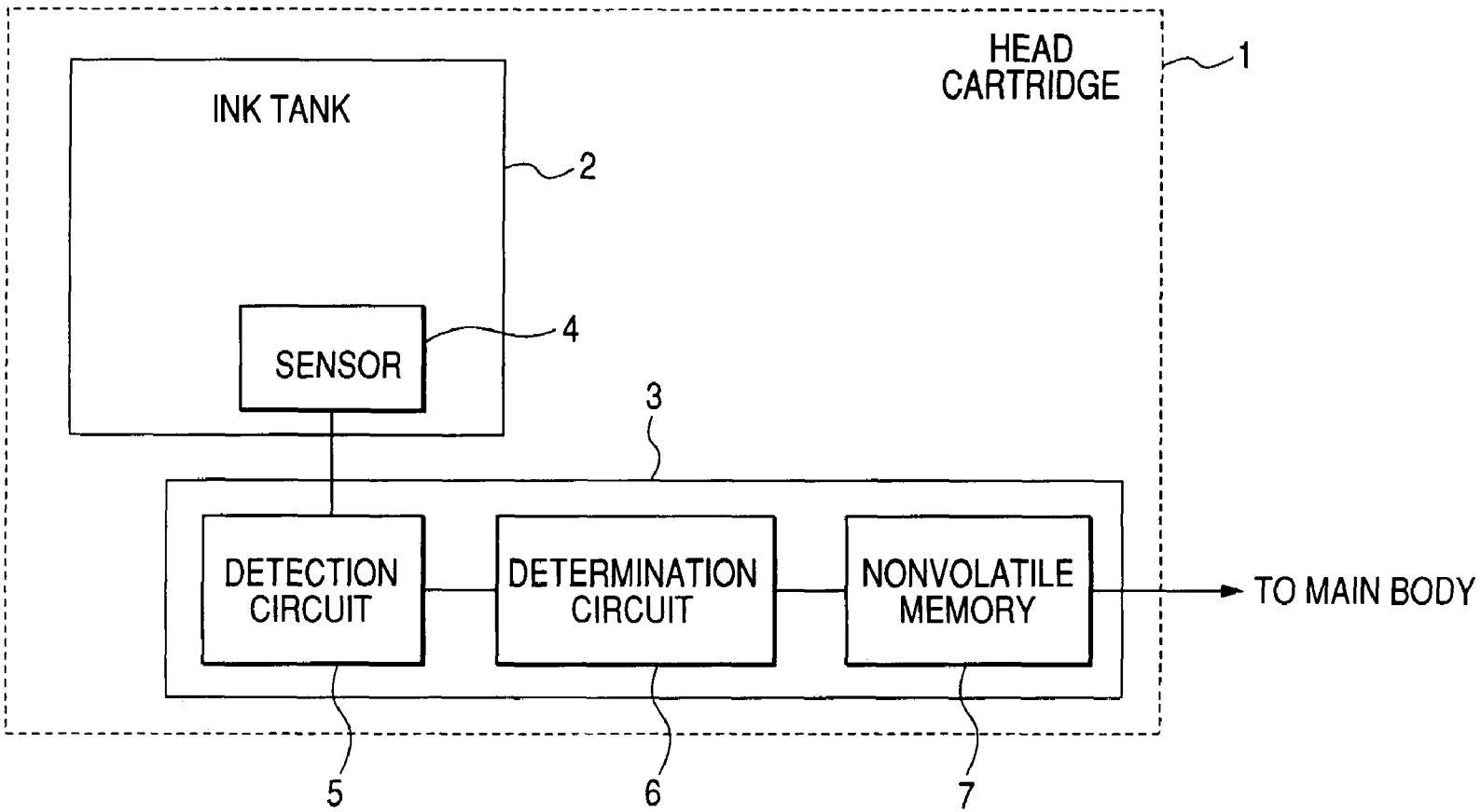
FIG. 1 is a schematic structural diagram showing a liquid discharge cartridge according to a first embodiment of the present invention.

In this embodiment, a liquid discharge apparatus will be explained with an example of an ink jet recording apparatus. FIG. 1 is a schematic structural diagram showing a liquid discharge cartridge according to a first embodiment of the present invention.

A head cartridge 1 of this embodiment has the structure that a print head 3 and an ink tank 2 which are formed separately are integrated. In the ink tank 2, a sensor 4 detecting residual ink amount in the ink tank 2 is provided. A signal outputted from the sensor 4 is inputted into a detection circuit 5 provided in the print head 3. An output from the detection circuit 5 is inputted into a judgment circuit 6 similarly provided in the print head 3, and an output from the judgment circuit 6 is inputted into nonvolatile memory 7 similarly provided in the print head 3.

The print head 3 is equipped with, for example, an ink ejection mechanism (not shown) including a nozzle which has a heat-generating resistor, which is an electrothermal converting element, and an ink ejection orifice, and a switching circuit (not shown) using a transistor which controls the injection and cutoff of energy to this ink ejection mechanism. Generally, such the print head 3 is constituted on a silicon substrate using semiconductor manufacturing process. Hence, it is possible to constitute the detection circuit 5, judgment circuit 6, and nonvolatile memory 7, which are mentioned above, on the silicon substrate. It is also possible to form these detection circuit 5, judgment circuit 6, and nonvolatile memory 7 monolithically on the same silicon substrate that forms a heater board on which the heat-generating resistor is formed. Thereby, it is possible to realize simple circuitry in comparison with the case that each circuit is constituted separately. In addition, a recording apparatus where the head cartridge is used is equipped with a control section (CPU) which supplies a drive control signal to the heat-generating resistor which is an electrothermal converting element.

Next, the detecting operation of residual ink amount by the head cartridge of this embodiment will be explained.

The detection circuit 5 of the print head 3 detects the presence of residual ink amount in the ink tank 2 by the sensor 4 located in the ink tank 2. The detection circuit 5 outputs a signal, correlating to the presence of residual ink amount, to the judgment circuit 6. The judgment circuit 6 judges from the signal, outputted from the detection circuit 5, whether the residual ink amount is zero. When judging that the residual ink amount is zero, the judgment circuit 6 records the information (ink zero information), correlating to the residual ink zero amount, in the nonvolatile memory 7. The judgment circuit 6 does not record information on the nonvolatile memory 7 when judging that the residual ink amount is not zero. The ink zero information stored in the nonvolatile memory 7 can be read, for example, by a read/write section (not shown) of a printer body. In addition, "residual ink amount is zero" includes not only the case that there is no residual ink amount in the ink tank 2 completely, but also the case that the residual ink amount in the ink tank 2 is less than predetermined amount.

It is no matter that the timing of detecting the residual ink amount in the ink tank 2 by the sensor 4 and detection circuit 5 which are mentioned above is on waiting or during the recording operation of a printer. When the ink zero information is read from the nonvolatile memory 7, the printer body outputs an information signal including a message of that ink in the ink tank 2 became empty to inform a user of the printer of this. This message may be communicated to the user by being displayed on a display unit (not shown) of the printer body, or also by being displayed on a display unit connected to a host computer (personal computer) which controls the printer.

According to the structure of this embodiment, the sensor 4, detection circuit 5, judgment circuit 6, and nonvolatile memory 7 which constitute the circuit closed within the head cartridge 1 can detect the presence of the residual ink amount in the ink tank 2. As mentioned above, these detection circuit 5, judgment circuit 6, and nonvolatile memory 7 are constituted on the silicon substrate of the print head 3 using the semiconductor manufacturing process. Hence, it is possible to reduce manufacturing cost in comparison with the case that they are constituted separately on a circuit board of the printer body. In addition, according to the structure of this embodiment, it is possible to detect residual ink amount without using a CPU of a host computer. Hence, since the residual ink amount is detectable so long as only the printer body is started, it is possible to increase convenience for a user. In addition, since it is not necessary to provide a three-dimensional semiconductor device for detection in an ink tank separately, structure becomes simple.

Furthermore, since the head cartridge 1 in itself is equipped with the nonvolatile memory 7 in this embodiment, information is stored in the nonvolatile memory 7 as it is, even if it is removed from the printer body once and is mounted on the printer body again. Therefore, it is detectable whether the ink tank 2 of the head cartridge 1 which is mounted on the printer body is empty, by reading in the read/write section of the printer body whether ink zero information is stored in the nonvolatile memory 7. What was performed in a conventional printer was the sequence of detecting residual ink amount in an ink tank of a head cartridge when the head cartridge was newly mounted in a printer body. According to this embodiment, it is possible to detect the residual ink amount without performing such sequence. Thereby, it is possible promptly to inform a user of that there is no residual ink amount, and further, it is possible to shorten recording operation time of the printer by the time which sequence operation needs.

Second Embodiment

Figure 2:
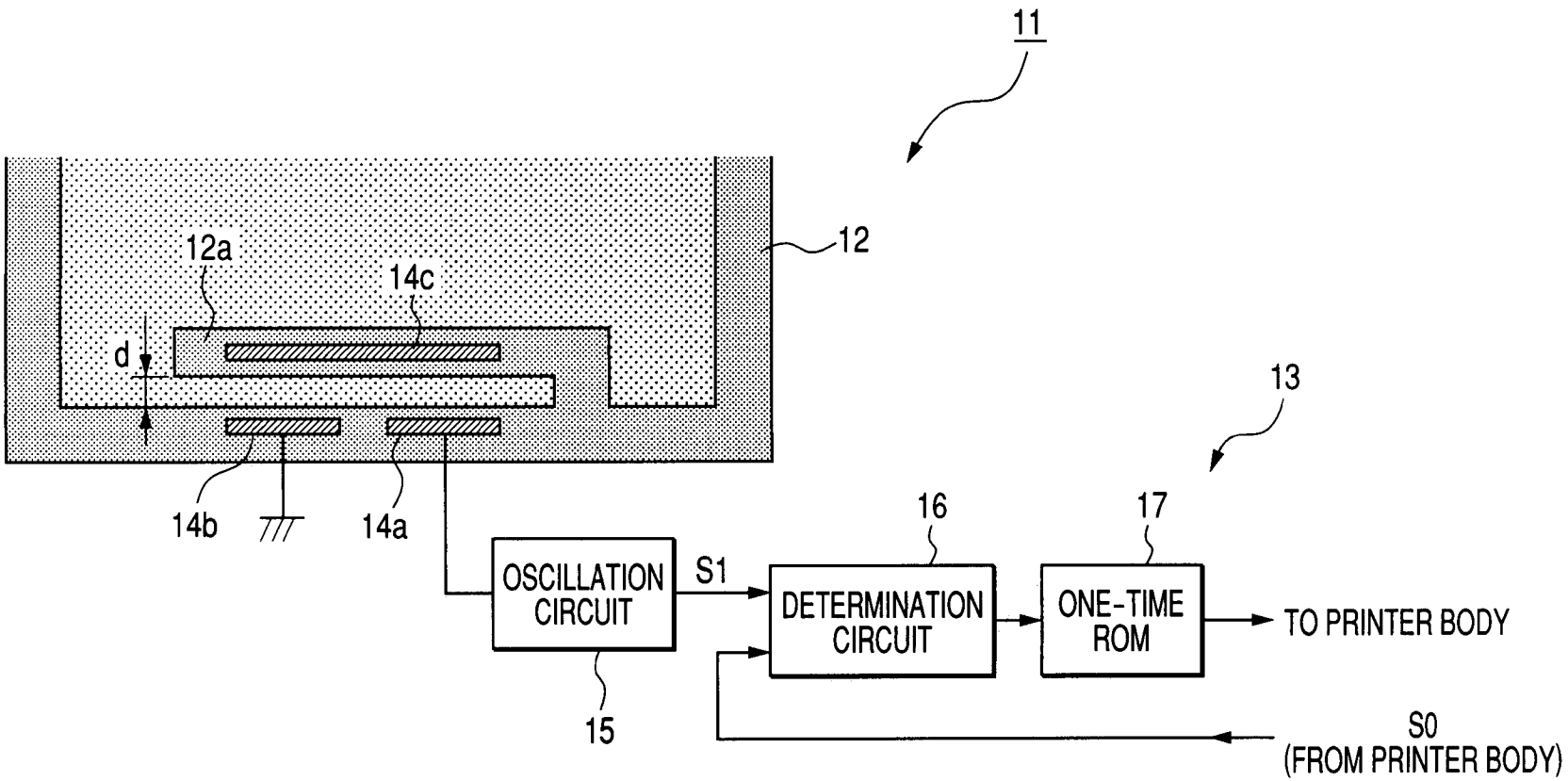
FIG. 2 is a schematic structural diagram showing a liquid discharge cartridge according to a second embodiment of the present invention.

FIG. 2 is a schematic structural diagram showing a head cartridge according to a second embodiment of the present invention.

A head cartridge 11 of this embodiment also has the structure that a print head 13 and an ink tank 12 which are formed separately are integrated, similarly to the first embodiment. In the ink tank 12, three plate-like electrodes 14*a*, 14*b*, and 14*c* which function as a sensor which detects the presence of residual ink amount in the ink tank 12 are provided. The print head 13 has an oscillation circuit 15 which outputs a signal S1 obtained when a pulse signal at a predetermined frequency is inputted into the first electrode 14*a*, a judgment circuit 16 where the output signal S1 from the oscillation circuit 15 and a control signal S0 from a control section (not shown) of a printer body are inputted, and one-time ROM 17 into which the output from the judgment circuit 16 is inputted. These oscillation circuit 15, judgment circuit 16, and one-time ROM 17 are constituted on a silicon substrate of the print head 13 using the semiconductor manufacturing process. In addition, the one-time ROM is ROM (Read Only Memory) in which information can be written only once.

The electrodes 14*a*, 14*b*, and 14*c* of the ink tank 12 will be explained. The first electrode 14*a* and second electrode 14*b* out of the three electrodes are embedded inside a wall of the ink tank 12 with leaving a space between themselves. The oscillation circuit 15 is connected to the first electrode 14*a*, and the second electrode 14*b* is connected to GND potential. The third electrode 14*c* is provided in an electrode supporting section 12*a* which is made of the same material (plastics etc.) as that of a wall member of the ink tank 12. The electrode supporting section 12*a* is extended from the bottom of the ink tank 12 with leaving a gap d between with a wall portion of the ink tank 12 so that the electrode supporting section 12*a* may cover the two electrodes 14*a* and 14*b* provided in the wall portion of the ink tank 12.

The gap d is a gap between the wall portion of the ink tank 12 and electrode supporting section 12*a*. It is necessary to secure such a gap that ink flows in freely between the electrodes 14*a* and 14*b* provided in the wall portion of the ink tank 12, and the electrode 14*c* provided in the electrode supporting section 12*a*.

In addition, arrangement places of the electrodes 14*a*, 14*b*, and 14*c* may be places where ink can flow in between the electrodes 14*a* and 14*b*, and electrode 14*c*, and where ink does not exist in the gap d between the electrodes 14*a* and 14*b*, and electrode 14*c* when the residual ink amount in the ink tank 12 becomes zero or becomes less than predetermined amount. In addition, the electrodes 14*a*, 14*b*, and 14*c* may be located vertically, or may be located horizontally. Furthermore, it is also good to have the structure that the oscillation circuit 15 is connected to the second electrode 14*b*, and the first electrode 14*a* is connected to GND potential.

The electrodes 14*a*, 14*b*, and 14*c* located as shown in FIG. 2 constitute capacitance C1 constituted of the electrode 14*a* and electrode 14*c*, and capacitance C2 constituted of the electrode 14*b* and electrode 14*c*, which are connected in series to the oscillation circuit 15. An oscillation frequency of the output signal S1 which the oscillation circuit 15 outputs is determined by the series capacitance CX of the capacitance C1 and capacitance C2 which are mentioned above.

Figure 3:
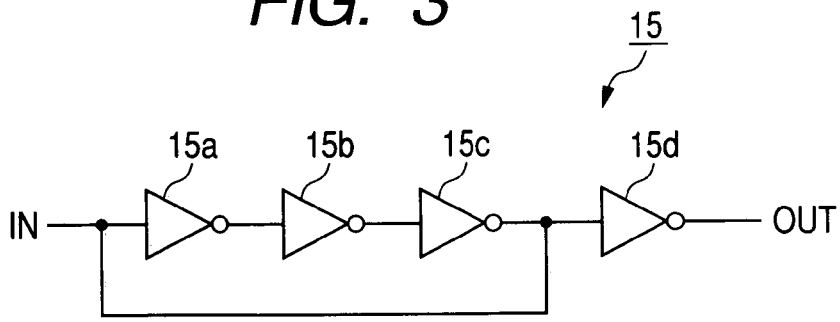
FIG. 3 is a block diagram showing one configuration example of an oscillation circuit shown in FIG. 2.

FIG. 3 is a block diagram showing one configuration example of the oscillation circuit shown in FIG. 2.

The oscillation circuit 15 consists of a ring oscillator constituted of connecting odd stages (three stages in FIG. 3) of inverters 15*a*, 15*b*, and 15*c* in series. An inverter 15*d* connected to the inverter 15*c* of the last stage of the ring oscillator is a buffer for transmitting the signal S1 to the following stage of judgment circuit 16. Then, when the driving capability of inverters which constitute a ring oscillator is large, it is not necessary to always provide this inverter.

Figure 4:
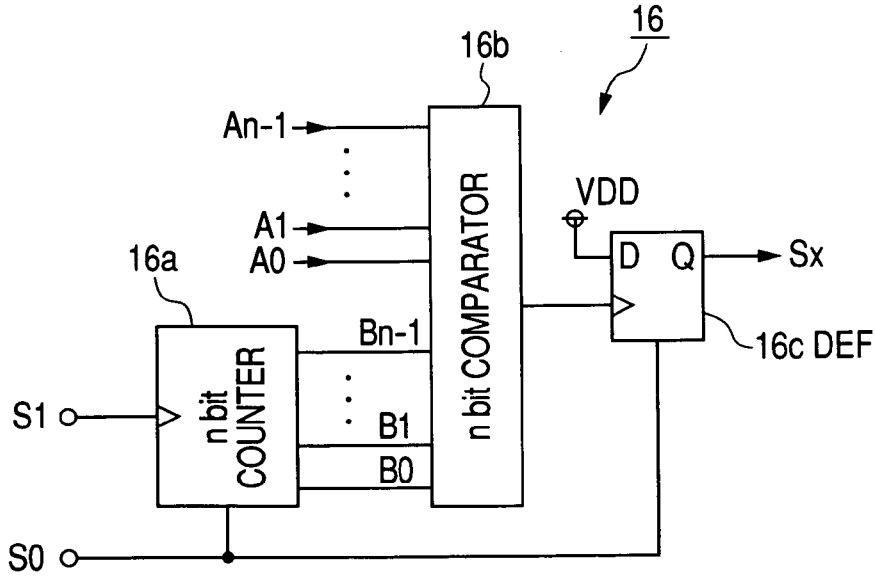
FIG. 4 is a block diagram showing one configuration example of a judgment circuit shown in FIG. 2.

FIG. 4 is a block diagram showing one configuration example of the judgment circuit shown in FIG. 2.

The signal S1 from the oscillation circuit 15 is inputted into a clock terminal of an n-bit counter 16*a*, and its output (B0 to Bn-1) is inputted into an n-bit comparator 16*b*. The n-bit comparator 16*b* inputs an n-bit signal (A0 to An-1), used as a criterion, besides the output from the n-bit counter 16*a*, and outputs a high level when respective bits of the signal (A0 to An-1) and signal (B0 to Bn-1) are equal. The output from the n-bit comparator 16*b* is inputted into a clock terminal of a D flip-flop (DFF) 16*c*. A D terminal of the DFF 16*c* is connected to a first power supply vdd becoming a high-level of logic. A control signal SO from the control section (not shown) of the printer body is inputted into a reset terminal of the n-bit counter 16*a*, and a reset terminal of the DFF 16*c*.

Figure 5:
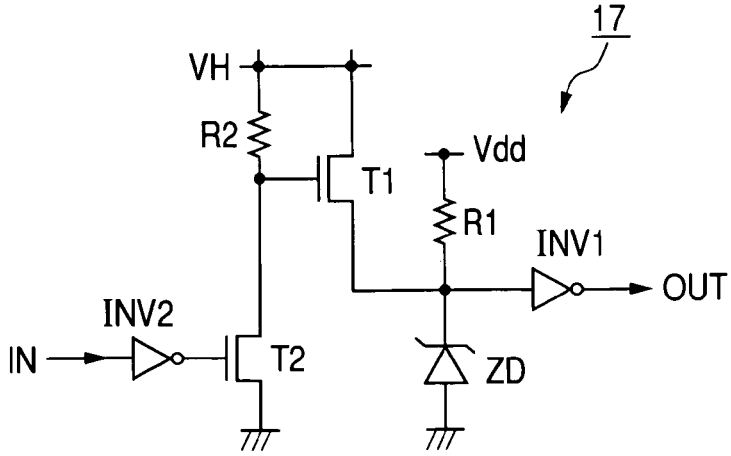
FIG. 5 is a block diagram showing one configuration example of a one-time ROM shown in FIG. 2.

FIG. 5 is a block diagram showing one configuration example of a one-time ROM shown in FIG. 2.

One-time ROM 17 used in this embodiment is Zener zap type memory which uses a Zener diode ZD. An anode of the Zener diode ZD is connected to the GND potential, and a first resistance R1, a source of a first n-type transistor T1, and an input terminal of a first inverter INV1 are connected to a cathode of the Zener diode ZD. Another end of the first resistance R1 is connected to the first power supply vdd becoming the high level of logic. A drain of the first transistor T1 is connected to a second power supply VH necessary for writing information. A voltage of the second power supply VH is higher than the voltage of the first power supply vdd, and higher than a peak inverse voltage of the Zener diode ZD. A second resistor R2 and a drain of the second transistor T2 are connected to a gate of the first transistor T1. Another end of the second resistor R2 is connected to the power supply VH, and a source of the second transistor T2 is connected to the GND potential. An output of a second inverter INV2 is inputted into a gate of the second transistor T2.

The one-time ROM 17 constituted in this way outputs to the printer body an output signal which varies depending on whether ink zero information is stored in the one-time ROM 17, when an output of the judgment circuit 16 is inputted into the second inverter INV2. The detail of the operation will be described later.

It is conceivable to use, for example, flash memory or EEROM as nonvolatile memory for storing the presence of the residual ink amount in an ink tank. However, circuit structure becomes large more than needed when the flash memory or EEROM is used in spite of that memory capacity (number of bits) is at least 1 bit, and special production process is required. Hence, there is a possibility of leading to the cost increase of the print head 13. In this respect, the above-described memory configuration using the one-time ROM 17 is preferable.

In addition, the one-time ROM 17 can be also constituted of fuse memory which consists of polysilicon, in stead of the memory with the Zener zap type structure of being equipped with a Zener diode as described above. Since it is also possible to constitute such fuse memory on a silicon substrate of the print head 13 using semiconductor manufacturing process, it is rare to lead to the cost increase of the print head 13, eventually the head cartridge 11.

Figure 6A:
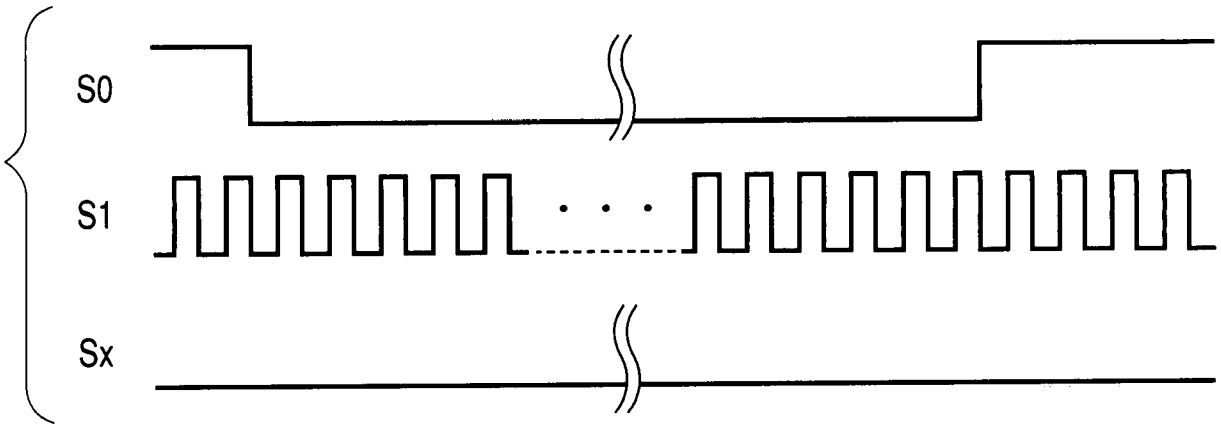
FIGS. 6A and 6B are operation timing charts of the judgment circuit shown in FIG. 4.
Figure 6B:
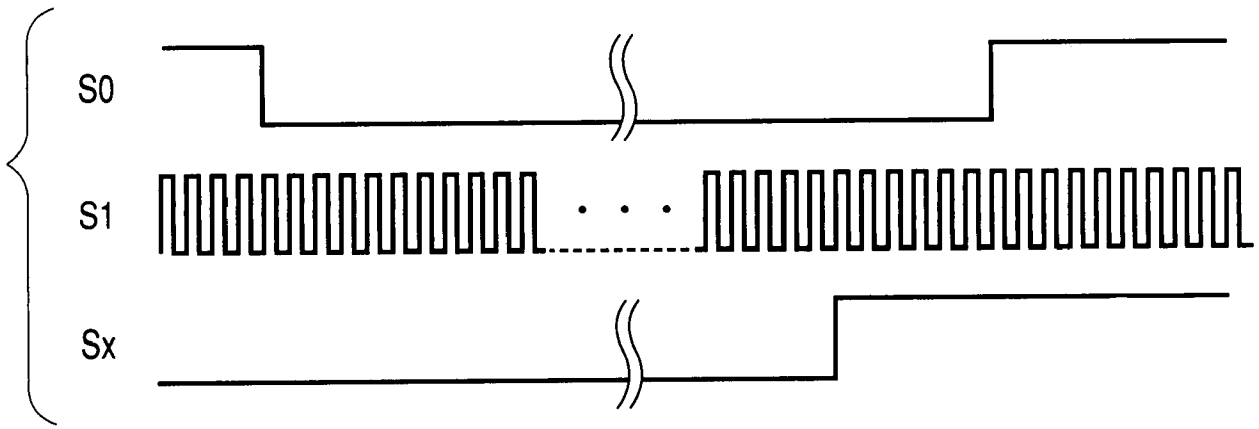

Next, the operation of the head cartridge 11 of this embodiment mentioned above will be explained with reference to FIGS. 2 to 6A and 6B. FIGS. 6A and 6B are the operation timing charts of the judgment circuit shown in FIG. 4.

In order to detect the presence of the residual ink amount in the ink tank 12, the reset signal S0 outputted from the control section of the printer body is first made a low level, and the n-bit counter 16*a* and DFF 16*c* of the judgment circuit 16 are made operable. Then, when the signal S1 is outputted to the judgment circuit 16 from the oscillation circuit 15, the n-bit counter 16*a* starts counting. When the counter value of the n bit counter 16*a* does not reach a predetermined counter value (value which A0 to An-1 express) in the predetermined period whose signal S0 is a low level (refer to FIG. 6A), the output of the n-bit comparator 16*b* does not vary with a low level. Hence, the output of the DFF 16*c* which is the following stage does not vary also from the low level. On the other hand, when the counter value of the n-bit counter 16*a* reaches the predetermined counter value (value which A0 to An-1 express) (referring to FIG. 6B), the n-bit comparator 16*b* outputs a high level. Hence, an output of the DFF 16*c* which is the following stage becomes a high level.

A dielectric constant between each of the electrodes 14*a* and 14*b*, and electrode 14*c* varies according to whether ink exists in the gap d between the electrodes 14*a* and 14*b*, and electrode 14*c*. Thus, the series capacitance CX at the time when there is no ink in the gap d is less than the series capacitance CX at the time when ink is in the gap d. Therefore, when ink is in the gap d, the signal S1 at a comparatively low frequency is outputted from the oscillation circuit 15. At this time, the counter value of the n-bit counter 16*a* does not exceed the predetermined counter value in a predetermined period when the signal S0 is the low level. Hence, the output of the DFF 16*c* does not vary also from the low level.

On the contrary, when there is no ink in the gap d, the signal S1 at a comparatively high frequency is outputted from the oscillation circuit 15. At this time, the counter value of the n-bit counter 16*a* exceeds the predetermined counter value in the predetermined period when the signal S0 is the low level. Therefore, the output of the DFF 16*c* becomes a high level. When the output of the DFF 16*c* which is an output of the judgment circuit 16 becomes the high level, the information (ink zero information) that the residual ink amount in the ink tank. 12 is zero is recorded in the one-time ROM 17.

Here, with reference to FIG. 5 mainly, the operation of recording ink zero information in the one-time ROM 17 will be explained.

The case that there is residual ink amount in the ink tank 12 and ink exists in the gap d between the electrodes 14*a* and 14*b*, and electrode 14*c* will be described. Since the signal outputted from the judgment circuit 16 becomes the low level as mentioned above, the input into the gate of the transistor T2 becomes the high level, and the transistor T1 is turned off. Hence, the electric potential of an anode terminal of the Zener diode ZD becomes the same electric potential as the power supply vdd, and the output signal of the one-time ROM 17 becomes the low level.

On the other hand, the case that there is no residual ink amount in the ink tank 12 and ink does not exist in the gap d between the electrodes 14*a* and 14*b*, and electrode 14*c* will be described. Since the signal outputted from the judgment circuit 16 becomes the high level as mentioned above, the input into the gate of the transistor T2 becomes the low level, and the transistor T1 is turned on. When the transistor T1 is turned on, the electric potential of the anode terminal of the Zener diode ZD is pulled up to the electric potential of the power supply VH. The electric potential of the power supply VH is set to be higher than a peak inverse voltage of the Zener diode ZD. Hence, when being pulled up to the electric potential of the power supply VH, the electric potential of the anode terminal of the Zener diode ZD exceeds the peak inverse voltage of the Zener diode ZD, and hence, a large current flows a PN junction region of the Zener diode ZD. Then, the energy equal to the product of the voltage and current at this time becomes Joule's heat, aluminum in a PN junction region is fused by the heat, and the PN junction region becomes conductive. As a result, regardless of the state of the output signal from the judgment circuit 16, the input signal to the inverter INV1 of the one-time ROM 17 is always set in the low level, and the output signal of the one-time ROM 17 always becomes the high level.

That is, when the residual ink amount in the ink tank 12 becomes zero, a high-level output signal is being always outputted from the one-time ROM 17. In this way, the ink zero information is recorded on the one-time ROM 17. Therefore, only by the control section of the printer body determining whether the output signal from the one-time ROM 17 is the high level, the control section of the printer body can detect that the residual ink amount in the ink tank 12 became zero.

According to the structure of this embodiment, similarly to the first embodiment, the electrodes 14*a*, 14*b*, and 14*c* as a sensor, oscillation circuit 15, judgment circuit 16, and one-time ROM 17 which constitute a circuit closed within the head cartridge 11 can detect the residual ink amount in the ink tank 2. As mentioned above, these oscillation circuit 15, judgment circuit 16, and one-time ROM 17 can be constituted on a silicon substrate of the print head 13 using the semiconductor manufacturing process. Hence, it is possible to reduce manufacturing cost in comparison with the case that they are constituted separately on a circuit board of the printer body. In addition, according to the structure of this embodiment, it is possible to detect residual ink amount without performing the processing using a CPU of a host computer or a printer body. Hence, since the residual ink amount is detectable so long as only the printer body is started, it is possible to increase convenience for a user.

Furthermore, in this embodiment, since the head cartridge 11 in itself is equipped with the one-time ROM 17 as non-volatile memory, ink zero information is stored in the one-time ROM 17 when the ink in the ink tank 12 becomes empty. Hence, even if the head cartridge 11 was removed from the printer body once and is mounted in the printer body again, the ink zero information is stored in the one-time ROM 17 as it is. By reading this ink zero information by the control section of the printer body in which the head cartridge 11 is mounted (specifically, by determining whether the output from the one-time ROM 17 is the high level), it is detectable whether the ink tank 12 of the head unit 11 which is newly mounted in the printer body is empty. Therefore, according to this embodiment, residual ink amount can be detected promptly without performing the sequence for residual ink amount detection after a head cartridge is newly mounted in the printer body. Hence, it is possible promptly to inform a user of that there is no residual ink amount, and further, it is possible to shorten recording operation time of the printer by the time which sequence operation needs.

In addition, in the structure of the first embodiment shown in FIG. 1, in order to let the wiring, which connects the sensor 4 provided in the ink tank 2, and the detection circuit 5 outside the ink tank 2, pass, it is necessary to form a through hole in the wall section of the ink tank 2. In this case, in order to prevent ink from leaking from the through hole, it is necessary to take a measure of plugging up the through hole appropriately after letting the wiring pass the through hole. On the other hand, in the structure of this embodiment, the wiring connected to the electrodes 14*a* and 14*b* embedded in the wall section of the ink tank 12 does not penetrate the wall section of the ink tank 12. Hence, since there is no possibility of the ink in the ink tank 12 leaking even if the hole for letting the wiring pass is not plugged up, it is not necessary to take the measure of plugging up the hole. Therefore, it is possible to reduce the production man-hours of the ink tank 12 by labor hours of taking the measure of plugging up the hole, and further, to attain the manufacturing cost reduction of the ink tank 12.

Other Embodiments

A liquid discharge head (print head) is producible by forming a heat-generating resistor with a heat-generating resistor layer formed on an insulating layer of the semiconductor substrate of the print head of each embodiment mentioned above, and combining discharge opening forming members, such as molding resin and a top board consisting of a film, so as to form a discharge opening and a liquid path communicating therewith. Then, by constituting a head cartridge by connecting a liquid container (ink tank) to such the liquid discharge head, mounting this in a printer body, and supplying power supply potential from a power supply circuit of the printer body, and image data from an image processing circuit of the printer body to the liquid discharge head, the printer body and head cartridge mounted therein operate as an ink jet printer.

Figure 7:
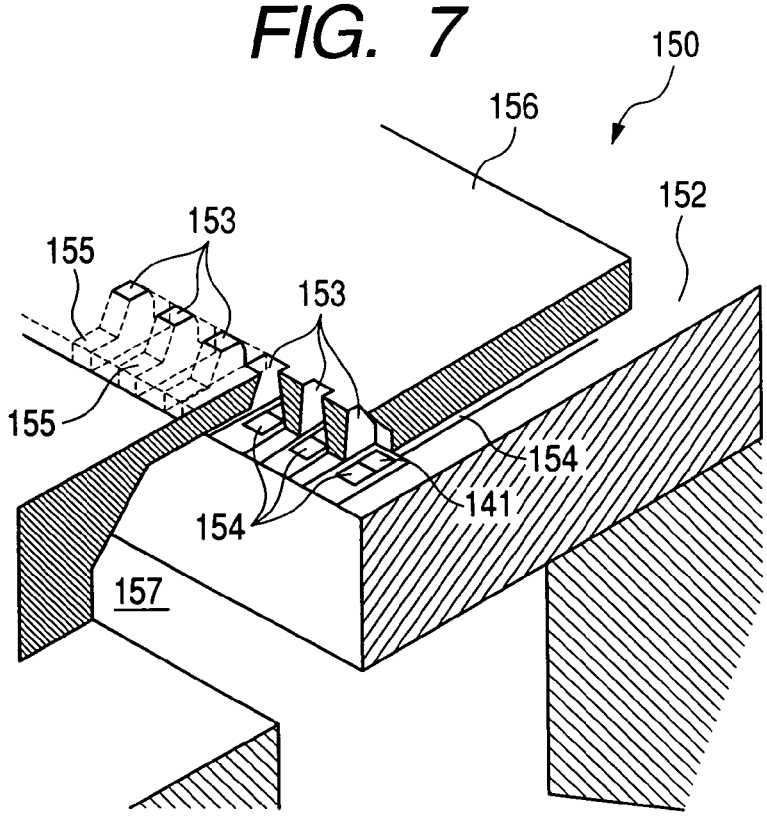
FIG. 7 is a drawing for explaining a discharge unit in one embodiment of a liquid discharge cartridge of the present invention.

FIG. 7 is a drawing for explaining a discharge unit in one embodiment of a liquid discharge cartridge of the present invention, and shows the discharge unit in the state that its part is cut.

Electrothermal conversion elements 141 which generate heat by receiving an electric signal to flow a current, and making ink discharged from discharge openings 153 with bubbles generated by the heat are arranged in two or more rows on an element substrate 152 which is a semiconductor substrate where the circuits shown in the explanation of the above- mentioned each embodiment are produced. A wiring electrode 154 which supplies an electric signal for driving each electrothermal conversion element 141 is provided in each of these electrothermal conversion elements 141.

A flow path 155 for supplying ink to each discharge opening 153 provided in a position opposite to each electrothermal converting element 141 is provided corresponding to each discharge opening 153. These discharge openings 153 and a wall constituting the flow paths 155 are provided in a grooved member 156. The flow paths 155 and a common liquid chamber 157 for supplying ink to a plurality of flow paths 155 are provided by connecting this grooved member 156 to the above-mentioned element substrate 152.

Figure 8:
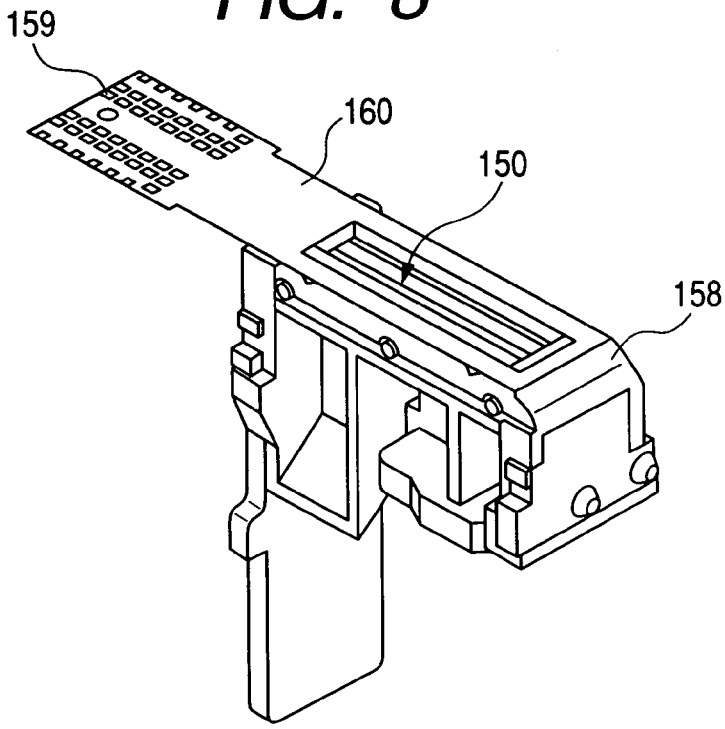
FIG. 8 is a perspective view showing the structure of the liquid discharge head where the discharge unit shown in FIG. 7 is incorporated.

FIG. 8 is a perspective view showing the structure of the liquid discharge head where the discharge unit shown in FIG. 7 is incorporated.

As shown in FIG. 8, a discharge unit 150 is built in a shell body 158. As mentioned above, the discharge unit 150 is constituted by the member 156 being mounted on the device substrate 152, the member 156 which constitutes the discharge openings 153 and flow paths 155. A flexible printed wiring board 160 on which contact pads 159 for receiving electric signals from the printer body are provided is connected to the discharge unit 150, and the electric signals used as various drive signals are supplied to the discharge unit 150 through the flexible printed wiring board 160 from the control section of the printer body.

Figure 9:
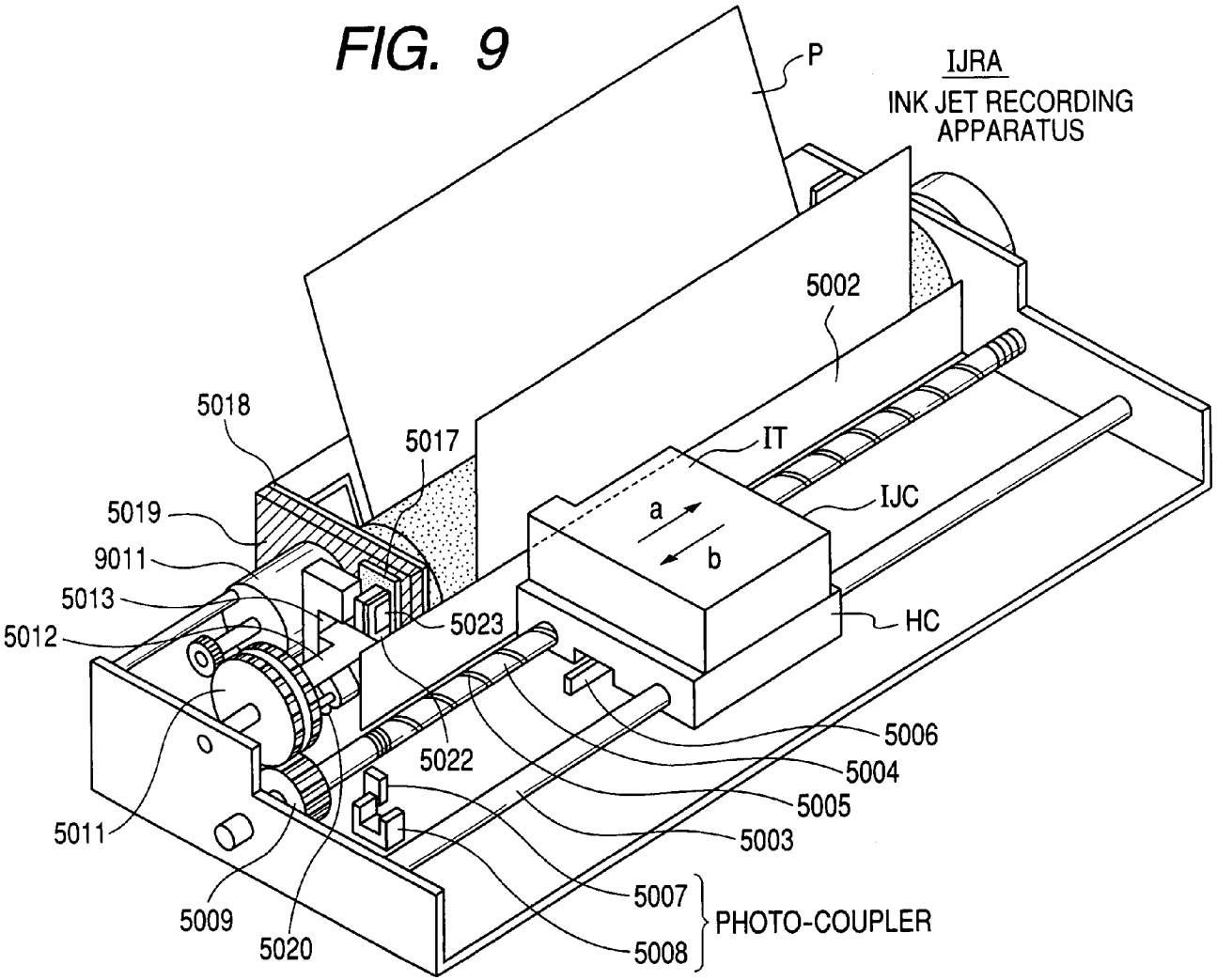
FIG. 9 is a perspective view showing the schematic configuration of an ink jet recording apparatus which is one embodiment of a liquid discharge apparatus to which a liquid discharge cartridge according to the present invention is applied.
Figure 10:
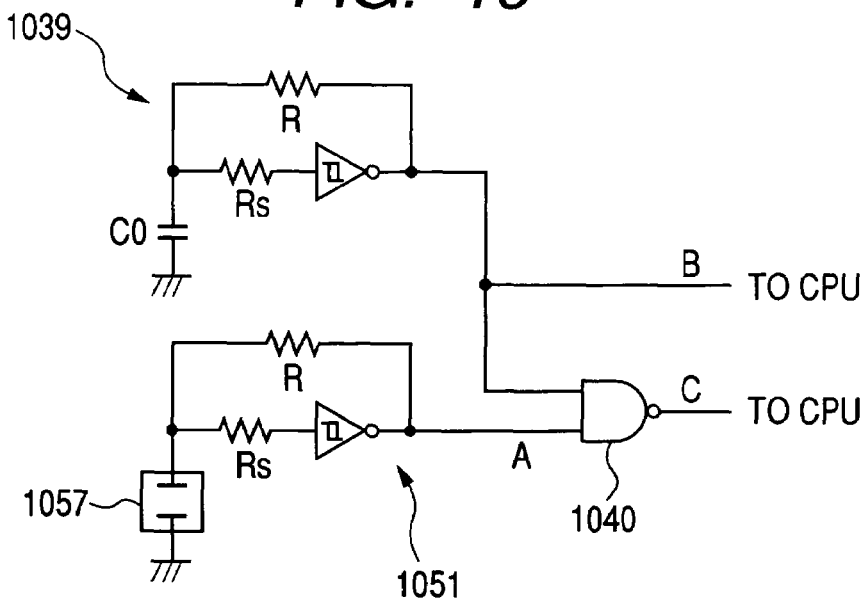
FIG. 10 is a circuit diagram of residual ink amount detection equipment by conventional art.
Figure 11:
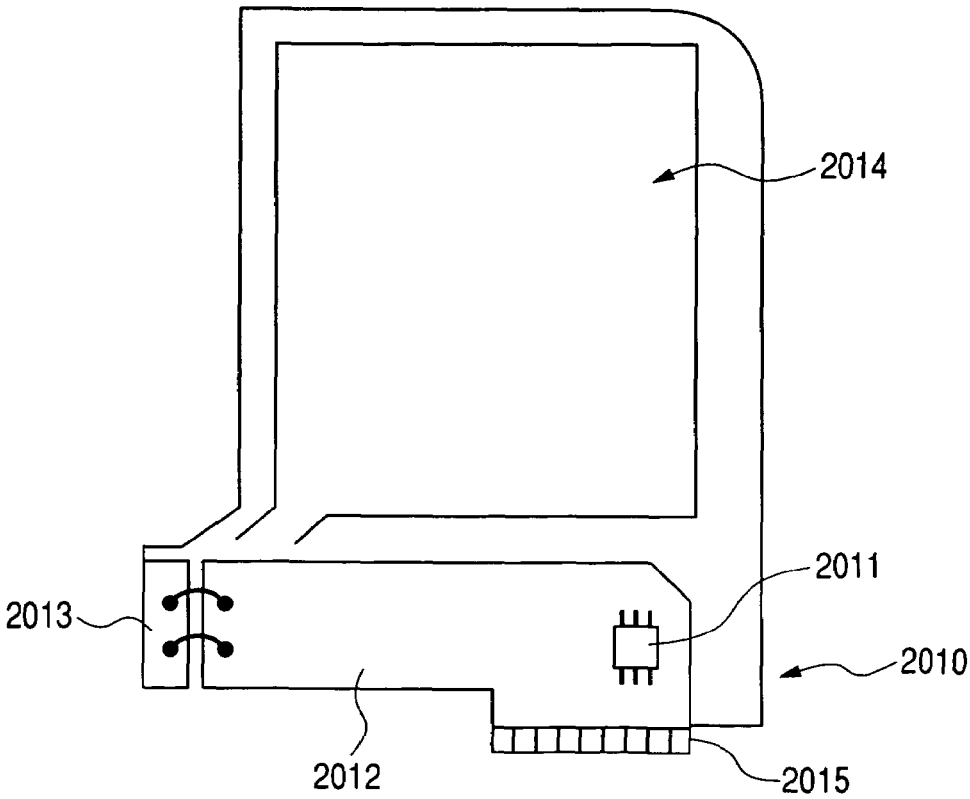
FIG. 11 is a drawing showing in multiple the structure of a conventional ink jet unit.

FIG. 9 is a perspective view showing the schematic configuration of an ink jet recording apparatus IJRA which is one embodiment of a liquid discharge apparatus to which a liquid discharge cartridge according to the present invention is applied.

A carriage HC which has a pin (not shown) engaged with a helical groove 5004 of a lead screw 5005 which is interlocked with the normal and reverse rotation of a drive motor 9011, and is rotated through driving force transmission gears 5011 and 5009 is reciprocated along with a guide shaft 5003 in the directions of arrows a and b in connection with the normal and reverse rotation of the lead screw 5005. A head cartridge including a recording head IJC and an ink tank IT which supplies ink to this is mounted in the carriage HC.

A paper pressure plate 5002 presses recording paper P to a platen (not shown), which is recording medium conveying means, over a moving range of the carriage HC. A photocoupler 5007 and 5008 as home position detecting means confirms the presence of a lever 5006 of the carriage HC in this range, and outputs a signal for switching the rotary direction of the drive motor 9011 or the like. A cap member 5022 which caps an ink ejection orifice formation face of the recording head IJC is supported by a supporting member 5013. When the suction of suction recovery is started, the lever 5012 moves with the movement of a cam 5020 engaging with the carriage HC, the driving force from the drive motor 9011 is switched by publicly-known transmission means such as clutch switching, and movement control is made so that the cap member 5022 may contact the ink ejection orifice formation face of the recording head IJC. By sucking the cap member 5022 by suction means (not shown) in this state, the suction recovery of the recording head IJC is performed through the opening 5023 in a cap.

The moving member 5019 which makes it possible to move a cleaning blade 5017 in the direction that the cleaning blade 5017 is brought close to or is separated from the recording head IJC is supported by a body supporting plate 5018, and the cleaning blade 5017 is provided in the moving member 5019. In addition, as for the cleaning blade 5017, it is needless to say that not only the shown form but also other widely known forms are applicable to this embodiment.

The ink jet recording apparatus IJRA is constituted so that the desired operation out of capping operation, cleaning operation, and suction recovery operation may be performed in each corresponding position, by making the lead screw 5005 perform predetermined rotation when the carriage HC moves to a home position region. The timing of performing these operations is well-known, and such widely known timing is also applicable to this embodiment. The above-mentioned each structure is excellent independently or complexly, and is a preferable configuration example to which the liquid discharge head in the present invention is applied.

In addition, this apparatus IJRA has an electrical circuit for supplying a supply voltage, an image signal, a drive control signal, and the like to the discharge unit 150 (refer to FIG. 7 and the like).

Furthermore, it is apparent that the present invention is not limited to the various embodiments mentioned above, and that it is possible to substitute an alternative or an equivalent for each component of the present invention so long as it can solve the subjects mentioned above.

This application claims priority from Japanese Patent Application No. 2004-115339 filed on Apr. 9, 2004, which is hereby incorporated by reference herein.

What is claimed is:

1. A liquid discharge cartridge integrally having a liquid discharge head discharging liquid, and a liquid container containing liquid supplied to the liquid discharge head, comprising:

in the liquid container, a sensor for detecting residual liquid amount in the liquid container; and in the liquid discharge head, detection means of detecting the residual liquid amount in the liquid container using the sensor, judgment means of judging presence of the residual liquid amount in the liquid container on the basis of an output from the detection means, and outputting zero residual liquid amount information when judging that there is no residual liquid amount in the liquid container, and nonvolatile memory means of storing zero residual liquid amount information when the zero residual liquid amount information is outputted from the judgment means, wherein the sensor contains at least two electrodes which face each other;

wherein the detection means includes an oscillation circuit to which electrostatic capacitance generated between the electrodes is connected as a load, and which oscillates a pulse signal whose oscillation frequency varies according to change of the electrostatic capacitance caused by presence of liquid between the electrodes, wherein the sensor includes three plate electrodes of which first and second plate electrodes are adjacent mutually, and of which a third plate electrode is located such that a space is left where liquid in the liquid container may flow in between the first and third plate electrodes, and such that the third plate electrode faces the first and second plate electrodes; and wherein the oscillation circuit is connected to one of the first and second plate electrodes and another electrode is connected to ground potential.

* * * * *